US008237619B2

(12) United States Patent
Vassilakis et al.

(10) Patent No.: US 8,237,619 B2
(45) Date of Patent: Aug. 7, 2012

(54) DUAL BEAM SECTOR ANTENNA ARRAY WITH LOW LOSS BEAM FORMING NETWORK

(75) Inventors: Bill Vassilakis, Orange, CA (US); Senglee Foo, Irvine, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 629 days.

(21) Appl. No.: 12/252,324

(22) Filed: Oct. 15, 2008

(65) Prior Publication Data

US 2009/0096702 A1 Apr. 16, 2009

Related U.S. Application Data

(60) Provisional application No. 60/999,182, filed on Oct. 16, 2007.

(51) Int. Cl.
*H01Q 21/00* (2006.01)

(52) U.S. Cl. ..... 343/836

(58) Field of Classification Search ..... 343/836, 343/702, 700 MS, 810
See application file for complete search history.

(56) References Cited

U.S. PATENT DOCUMENTS

| | | | | |
|---|---|---|---|---|
| 5,949,303 | A | 9/1999 | Arvidsson et al. | |
| 6,788,661 | B1 * | 9/2004 | Ylitalo et al. | 370/334 |
| 7,084,815 | B2 * | 8/2006 | Phillips et al. | 343/700 MS |
| 7,196,674 | B2 * | 3/2007 | Timofeev et al. | 343/810 |
| 7,817,096 | B2 | 10/2010 | Linehan | |
| 2007/0063791 | A1 * | 3/2007 | Wu et al. | 333/125 |
| 2007/0182634 | A1 * | 8/2007 | Yamamoto et al. | 343/700 MS |
| 2009/0021437 | A1 | 1/2009 | Foo | |
| 2009/0074109 | A1 | 3/2009 | Foo | |

OTHER PUBLICATIONS

International Search Report and Written Opinion pertaining to Application No. PCT/US2008/80050 dated Dec. 22, 2008.

* cited by examiner

*Primary Examiner* — Huedung Mancuso
(74) *Attorney, Agent, or Firm* — OC Patent Law Group

(57) ABSTRACT

A low loss beam forming method and antenna structure are disclosed. The method and structure may preferably be used in forming two narrow beams within a cellular sector. This method allows an increase in the overall network capacity by using a three-column non-planar array and a compact, low-cost, low-loss 3-to-2 Beam-Forming Network (BFN). This structure produces two symmetrical beams with respect to the azimuth boresight. Radiation patterns of the two beams are designed to cover the entire azimuth coverage angle of a cellular sector with minimum beam-split loss and cross-over losses.

9 Claims, 6 Drawing Sheets

DUAL BEAM SECTOR ANTENNA ARRAY WITH LOW LOSS BEAM FORMING NETWORK

RELATED APPLICATION INFORMATION

The present application claims priority under 35 USC section 119(e) to U.S. provisional patent application Ser. No. 60/999,182 filed Oct. 16, 2007, the disclosure of which is incorporated herein by reference in its entirety.

BACKGROUND OF THE INVENTION

1. Field of the Invention

The present invention relates in general to radio communication systems and components. More particularly the invention is directed to antenna elements and antenna arrays for radio communication systems.

2. Description of the Prior Art and Related Background Information

Modern wireless antenna implementations generally include a plurality of radiating elements that may be arranged to provide a desired radiated (and received) signal beam width and azimuth scan angle. For a common three sector cellular coverage implementation each antenna will have a 65 degree (deg) azimuthal coverage area. It is desirable to achieve a near uniform beam pattern that exhibits a minimum variation over the desired azimuthal degrees of coverage. In modern applications, it is also necessary to provide a consistent beam width over a wide frequency bandwidth.

In addition in modern cellular applications a number of antenna elements may be configured in an array to provide beam control by phase control of the beam, for example to provide beam tilt or beam steering. Providing an antenna array with a number of antenna elements in a typical cellular installation can create problems related to antenna weight and size. Also, cost is very important in such applications. Accordingly, providing the desired antenna performance is made more difficult by the need to maintain low cost, weight and size.

Consequently, there is a need to provide an improved antenna structure with desired beam uniformity over a desired coverage area. Furthermore, it is desirable to provide such an antenna in a relatively compact and low cost construction suitable for use in antenna arrays.

SUMMARY OF THE INVENTION

In a first aspect the present invention provides an antenna array comprising first, second and third generally planar reflectors each having one or more radiators coupled thereto, the second reflector configured adjacent to and between the first and third reflectors. The first and third reflectors are configured with their planar surfaces oriented at opposite angles between about 20 to 30 degrees relative to that of the second reflector. The antenna array includes beam forming means coupled to the radiators for providing a dual beam radiation pattern from the radiators.

In a preferred embodiment of the antenna array the dual beam radiation pattern comprises an approximately 33 degree half power beam width for each of the dual beams forming a total beam pattern of approximately 65 degrees at half power beam width. The beam forming means preferably comprises means for combining signals provided to the radiators and means for providing an unequal splitting of the signals provided to the radiators. The means for providing an unequal splitting preferably employs an unequal amplitude weight function. The beam split loss is less than about 0.25 dB. The beam forming means preferably comprises a microstrip transmission line pattern and the transmission line pattern and line width implement the unequal amplitude weight function. The means for providing an unequal splitting preferably comprises first and second 180 degree splitters. The means for combining signals preferably comprises first and second 0 degree combiners. The beam forming means preferably further comprises means for coupling the first and second 180 degree splitters and the first and second 0 degree combiners with a non-overlapping transmission line pattern.

In another aspect the present invention provides an antenna array comprising a reflector structure having a center panel and first and second outer panels with respective generally planar panel surfaces oriented in different directions. One or more first radiators are coupled to the first outer panel, one or more second radiators are coupled to the second outer panel, and one or more third radiators are coupled to the center panel. The antenna array further comprises first, second and third radiator coupling ports, first and second RF signal input coupling ports, and a three to two beam forming network coupled between the first, second and third radiator coupling ports and the first and second RF signal input coupling ports. The beam forming network comprises a first 0 degree combiner, a second 0 degree combiner, a first 180 degree splitter, a second 180 degree splitter, and a non-overlapping transmission line pattern coupling the splitters and couplers to the first and second RF signal input coupling ports and the first, second and third radiator coupling ports.

In a preferred embodiment of the antenna array each of the first, second and third radiators comprise plural radiators, respectively configured on the first and second outer panels and center panel in first, second and third columns, respectively. The first, second and third plural radiators may be arranged in groups of six radiators wherein each group is coupled to a beam forming network. The transmission line, splitters and couplers together comprise a microstrip line pattern having plural segments of varying width and length to implement a phase and amplitude control to create a dual beam radiation pattern from the first, second and third radiators. The first 0 degree combiner and second 0 degree combiner are preferably coupled directly to the first and second RF input signal coupling ports, the first 180 degree splitter and second 180 degree splitter are preferably coupled directly to the first and second radiator coupling ports and the first 180 degree splitter and second 180 degree splitter are preferably coupled to the third radiator coupling port by a split transmission line. The first 180 degree splitter and second 180 degree splitter are preferably both coupled directly to the first and second 0 degree combiners. The first and second 0 degree combiners are preferably configured symmetrically on opposite sides of the first and second 180 degree splitters. The split transmission line and third radiator coupling port are preferably configured between the first and second 0 degree combiners and the first and second 180 degree splitters. The first and second outer panels are preferably oriented at angle of about 20 to 30 degrees relative to the center panel.

In another aspect the present invention provides a method of providing a dual signal beam radiation pattern in a wireless antenna array. The method comprises providing a left and right beam signal to a beam forming network and providing first, second and third signals from the beam forming network to at least three radiators respectively configured on three separate non-planar reflector panels, the signals having an amplitude and phase adjusted by the beam forming network to provide a dual beam radiation pattern.

In a preferred embodiment of the method of providing a dual signal beam radiation pattern the three separate non-planar reflector panels comprise left and right panels oriented at an angle of 20 to 30 degrees relative to a center panel and the dual beam radiation pattern comprises two symmetric approximately 33 degree beams at half power beam width, the dual beams together covering an azimuth angle of about 65 degrees.

Further features and advantages are set out in the following detailed description of the invention.

DETAILED DESCRIPTION OF THE INVENTION

Figure 1A:
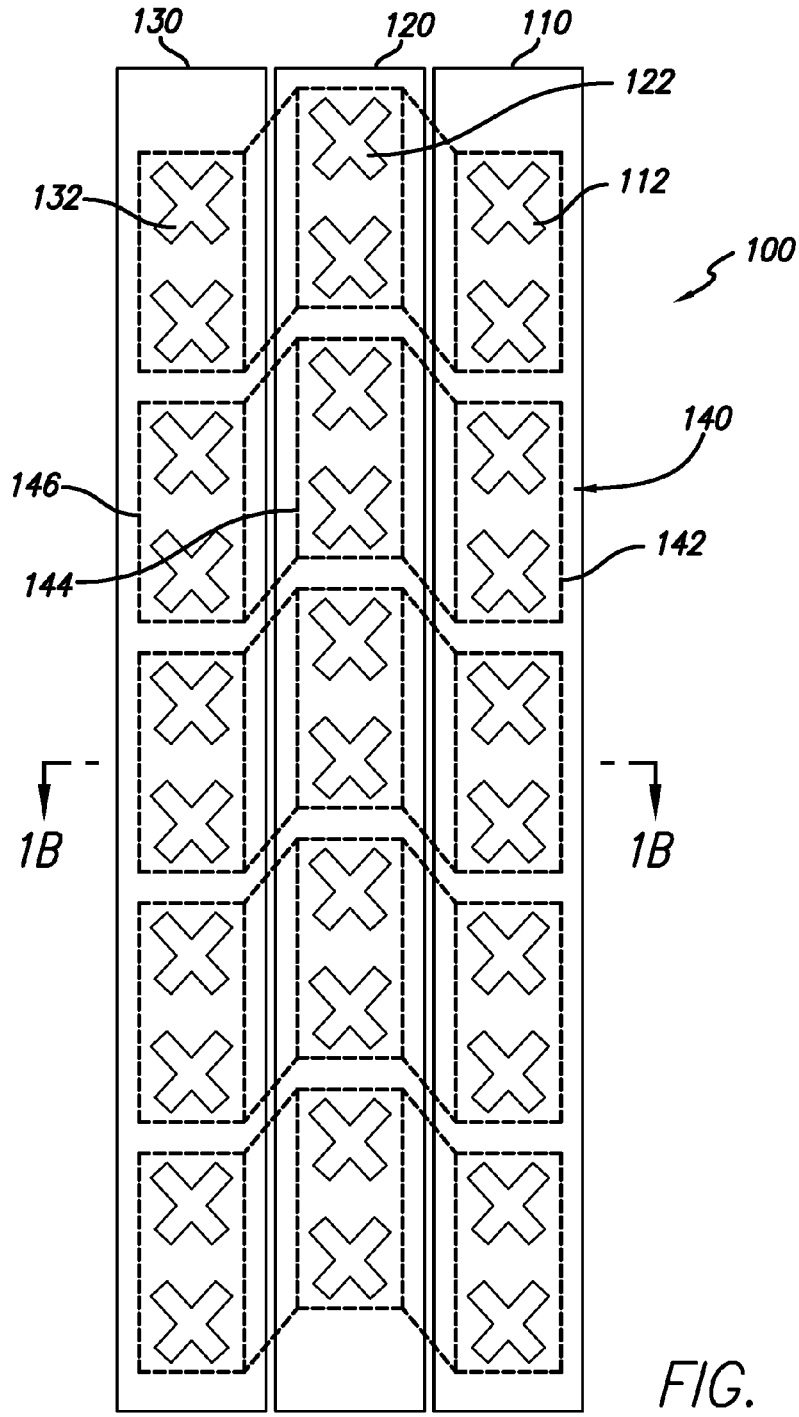
FIGS. 1A and 1B are front and sectional views respectively of an antenna array in accordance with a preferred embodiment of the invention.
Figure 1B:
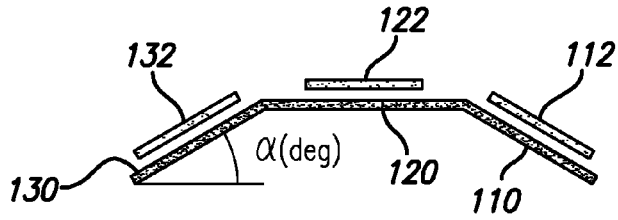

FIGS. 1A and 1B show the structure of a preferred implementation of a dual beam sector antenna array 100 in accordance with the invention. As shown in FIG. 1A, radiators 112, 122 and 132 are mounted on three separate planar reflector panels 110, 120, 130 to form a non-planar three-column antenna array. For example the radiators 112, 122 and 132 may be aperture slot coupled patch antenna elements as generally shown. Other radiators may also be employed such as planar dipole, etc. as well known in the art. The relative slope of the two edge columns, $\alpha$, with respect to the center column, shown in FIG. 1B, is important in achieving the required pattern shapes and minimum cross-over and beam-split losses. Typically, a preferred range for this angle is between 20 deg to 30 deg with respect to the center column panel 120. A beam forming network described below creates dual beam radiation patterns from the three column radiator structure. The dual beam patterns can be maintained over a relatively broad frequency bandwidth.

To provide desired elevation beam control a plurality of vertically arranged antenna element groups 140 may be provided as shown. In the illustrated embodiment five groups 140 are shown but more or fewer may be provided depending on the application. As shown in the illustrated embodiment each group 140 includes left, center and right sub groups 142, 144 and 146 of antenna elements configured on respective panels 110, 120 and 130. This grouping corresponds to a separate beam forming network for each group of six radiators which may be respectively phase controlled to provide beam tilt capability. Different groupings are possible, however, including as few as three radiators per group or greater than six. Further details on such beam tilt control as well as details on suitable radiator and network coupling are provided in U.S. patent application Ser. No. 12/175,725 filed Jul. 17, 2008, the disclosure of which is incorporated herein by reference in its entirety. Remotely controllable down tilt based on remotely controllable signal phase shifting is also described in U.S. Pat. No. 5,949,303 incorporated herein by reference in its entirety.

Figure 2:
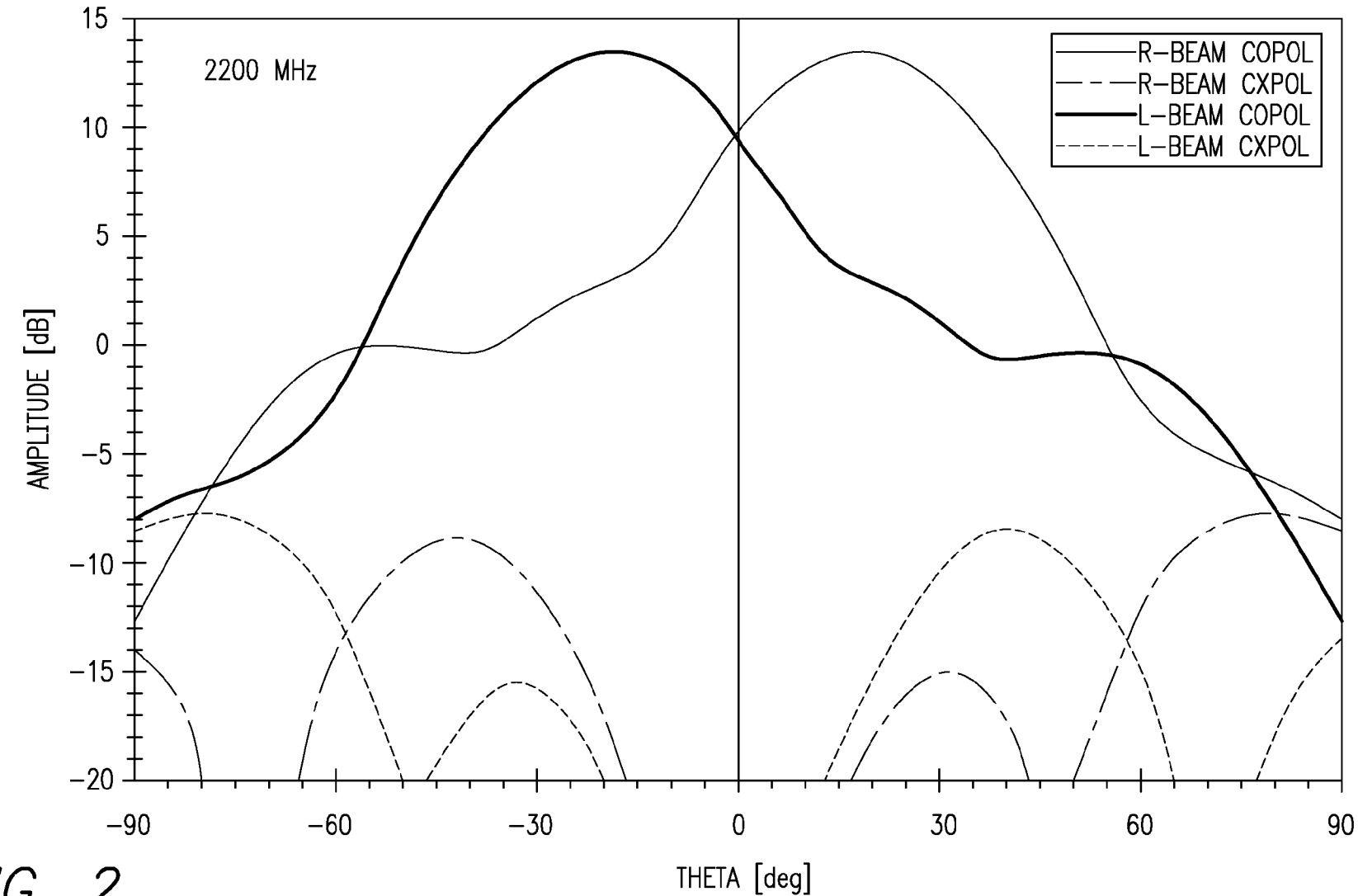
FIG. 2 is a graph showing the simulated dual beam patterns provided by the antenna array at an RF frequency of 2200 MHz.
Figure 3:
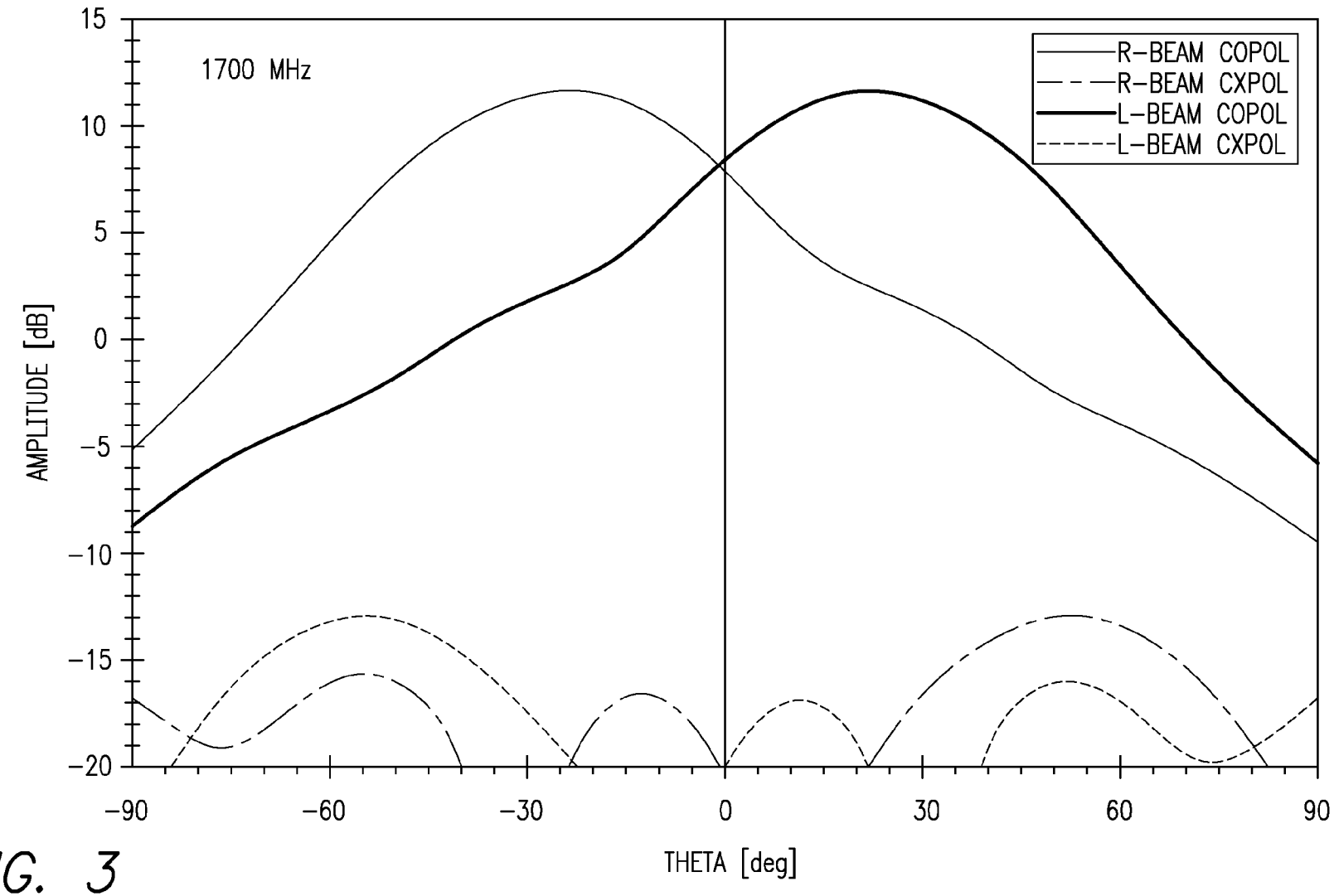
FIG. 3 is a graph showing the simulated dual beam patterns provided by the antenna array at 1700 MHz.

FIG. 2 and FIG. 3 show the simulated dual beam patterns at 2200 MHz and 1700 MHz. Both co-polarized (COPOL) and cross polarized (CXPOL) beam patterns are shown. In this case, the angle ($\alpha$) is set at 20 deg. The half-power beamwidth (HPBW) of each individual beam is approximately 33 deg, which provides combined azimuth coverage of 65 degrees. The cross-over pattern loss at AZ=0 deg is approximately 3.9 dB.

Figure 4:
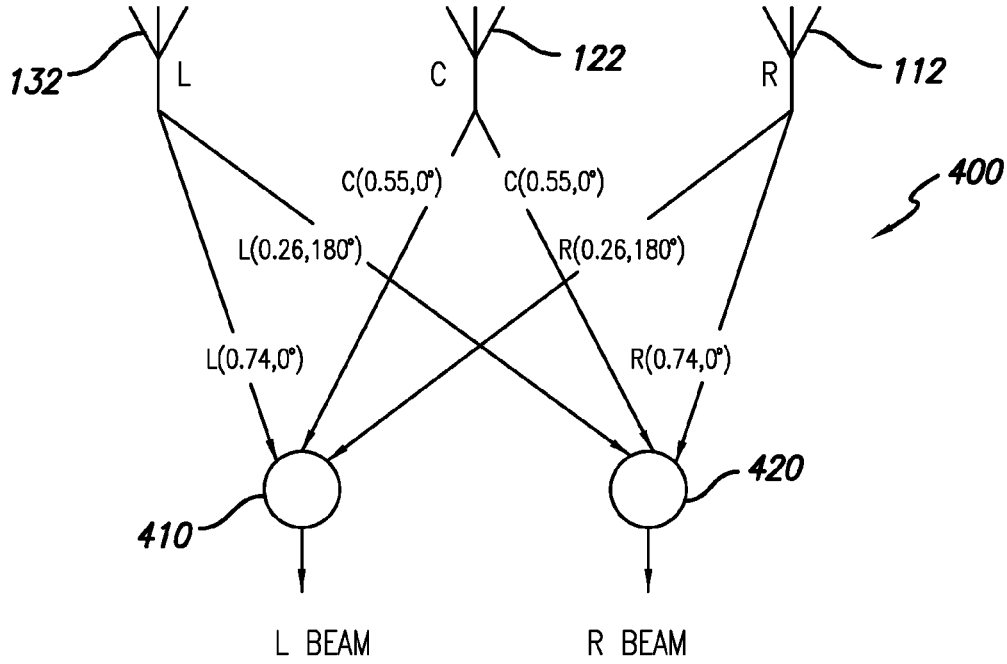
FIG. 4 is a schematic drawing of a beam forming network, showing amplitude and phase taper, for generating a dual beam pattern from the three column antenna array of FIG. 1.

FIG. 4 is a schematic drawing of a 3-to-2 Beam-Forming Network (BFN) 400 of the three-column antenna array in accordance with the present invention. One such network is preferably provided for each group of radiators 140 in the array of FIG. 1. FIG. 4 shows amplitudes and phases of the array at the input of the 3-to-2 Beam-Forming Network (BFN). The signal flow is shown flowing from the radiators but since the antenna will operate in both receive and transmit modes the opposite signal flow is equally implied. As shown the BFN 400 employs two splitters 410 and 420. Implementation of a 3-to-2 BFN using a traditional method, such as the Butler matrix, will require a series of parallel structures of hybrids and combiners. This leads to additional losses due to signal splits between the two beams and path losses in the series hybrids. The BFN 400 shown in contrast can reduce such undesirable beam losses as described in more detail below.

Figure 5:
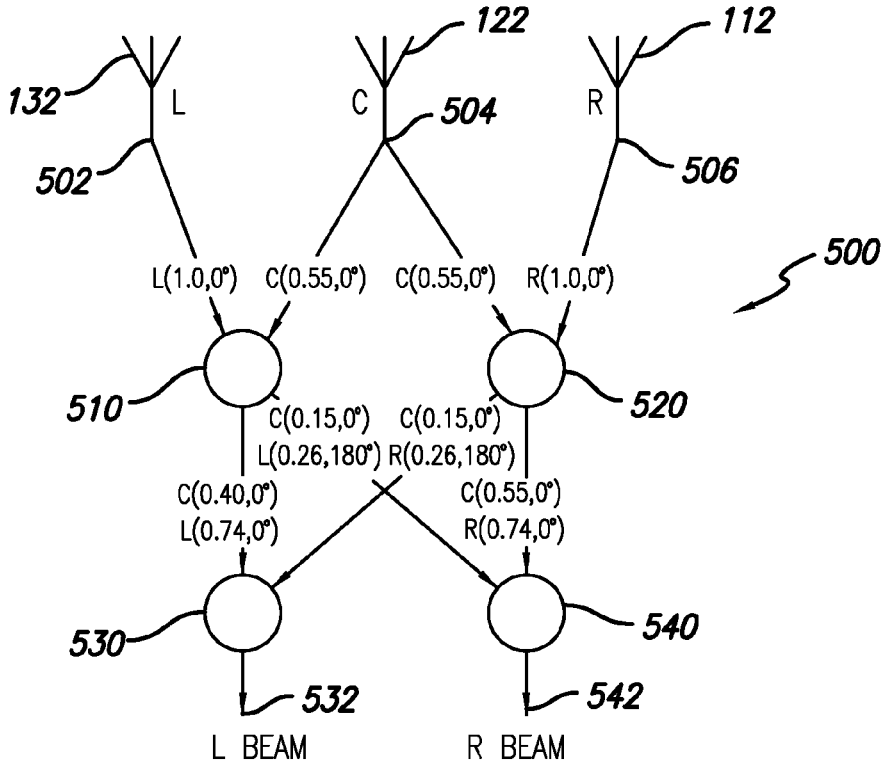
FIG. 5 is a schematic drawing of a preferred embodiment of the beam forming network, showing amplitude and phase taper, for generating a dual beam pattern from the three column antenna array of FIG. 1.

FIG. 5 shows a derived signal flow diagram of the 3-to-2 BFN in accordance with a preferred implementation 500 which reduces the number of signal path crossings which has advantages for a low cost and light weight microstrip implementation. The implementation 500 employs two 0 deg combiners 510, 520 and two 180 deg splitters 530, 540. The split coupling to port 504 also may be considered a 0 deg combiner. Also shown are the coupling ports 502, 504 and 506 to the antenna radiators and the RF signal input coupling ports 532, 542 to the external phase shifting network.

Figure 6:
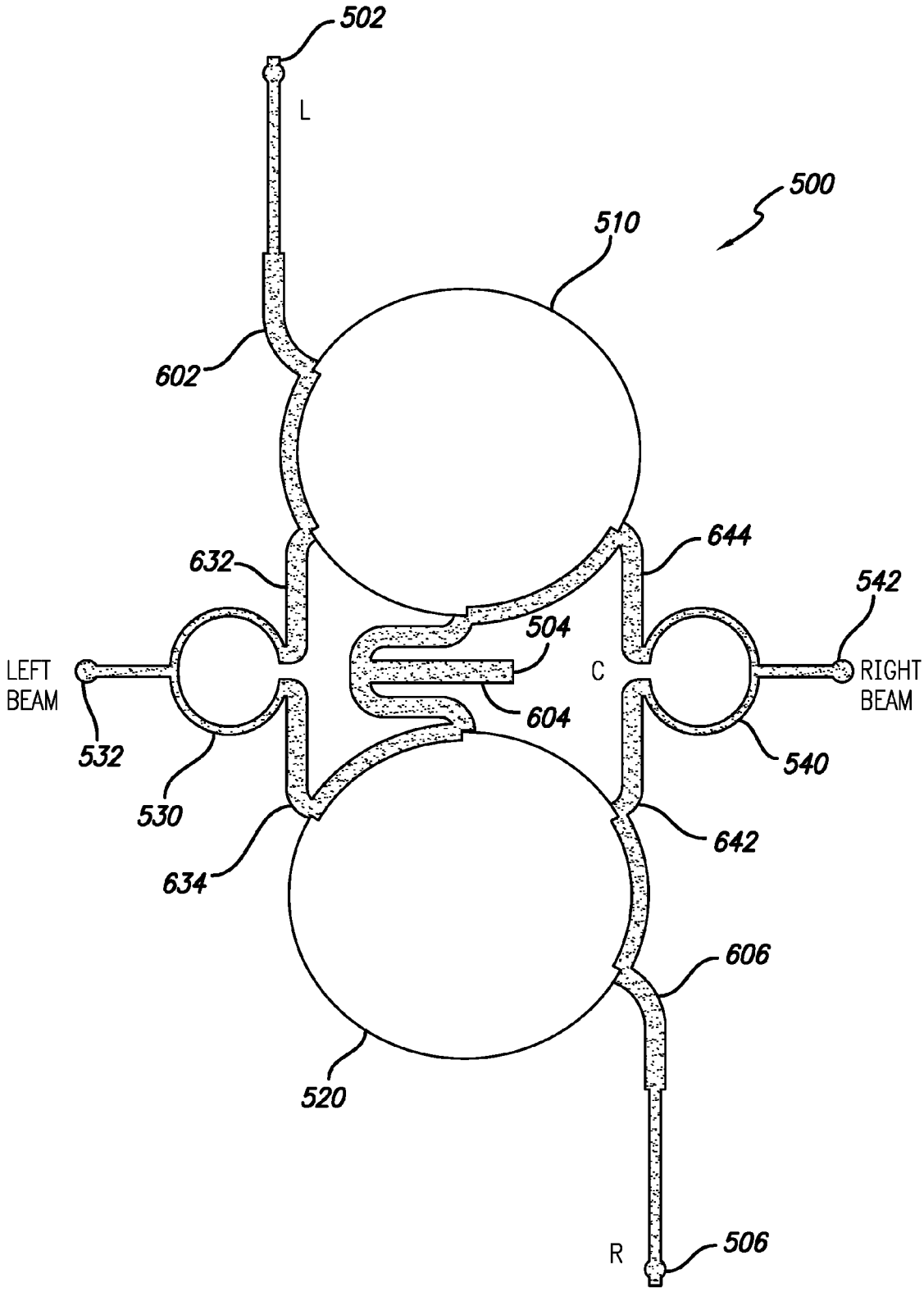
FIG. 6 is a schematic drawing of a microstrip implementation of the beam forming network of FIG. 5.

FIG. 6 shows the actual implementation of the BFN 500 using microstrip transmission lines. These microstrip transmission lines may be formed on a suitable substrate such as a planar dielectric material with a lower ground plane layer, as known in the art. With proper slope angles (a) for the two edge columns, for example, 20 deg, the 3-to-2 BFN can be formed using two unequally-split 180 deg splitters 510, 520 and two 0 deg combiners 530, 540. Also, the split microstrip line 604 may functionally be considered as a 0 deg combiner in coupling port 504 to the separate splitters 510, 520 as shown. The width and length of the microstrip line segments is chosen to implement the desired phase and amplitude relations set out in FIG. 5. The BFN implementation of FIG. 6 has a number of advantages. The use of microstrip lines while avoiding signal line crossovers simplifies construction and reduces cost and weight. Path length between ports is reduced, which also reduces RF losses. For, example strip segments 602, 632 between port 502 and 532, and similarly segments 604, 634, 604, 644 and 606, 642 between respective ports are configured to minimize path length as shown.

Figure 7:
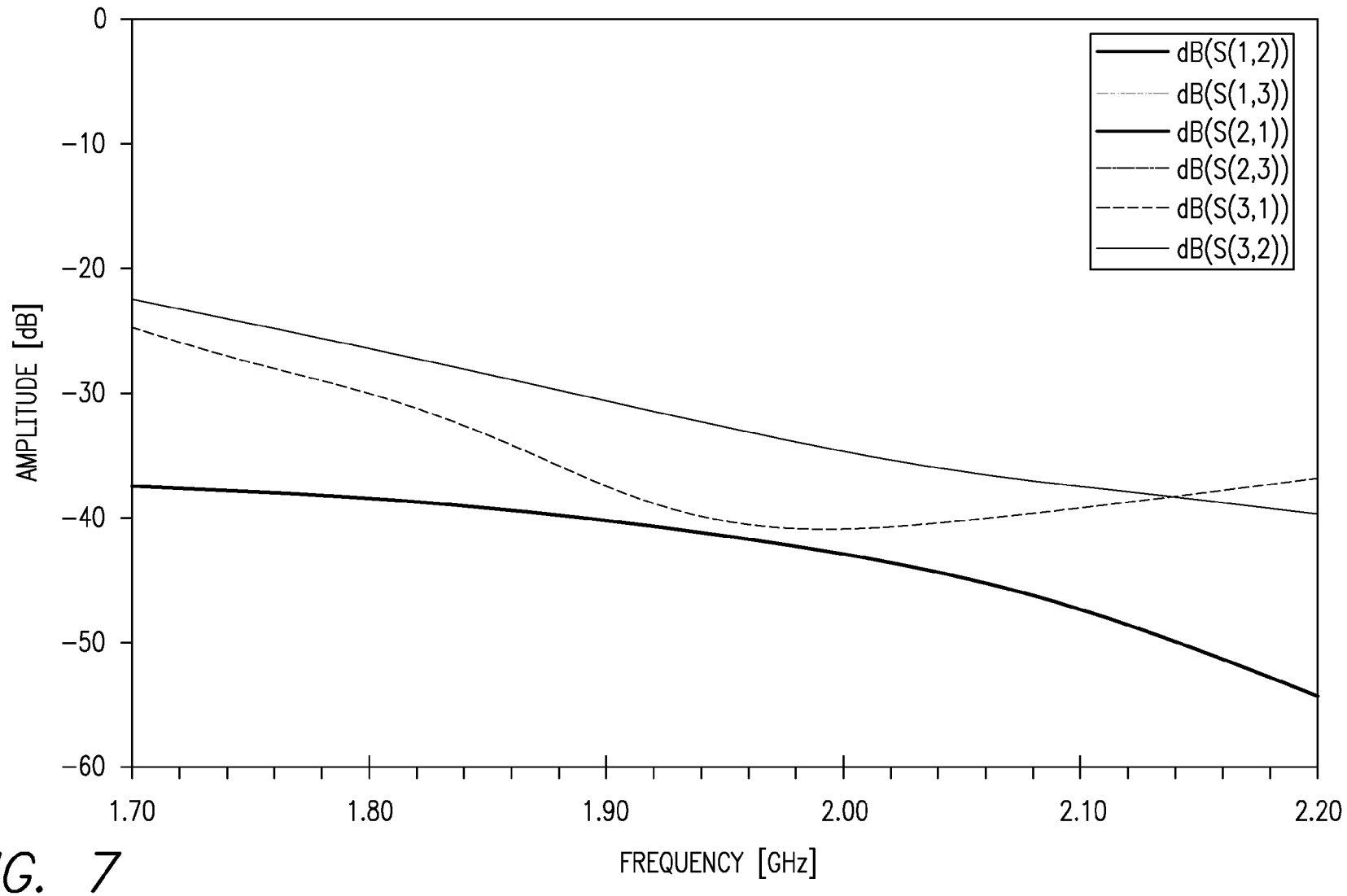
FIG. 7 is a graph showing the simulated isolation between the antenna ports of the beam forming network of FIGS. 5 and 6.

FIG. 7 is a graph showing the simulated isolation between the antenna ports of the beam forming network of FIGS. 5 and 6. As shown in FIG. 7, this simple implementation of the beam forming network has an inherently high isolation between antenna ports from the port cancellation at the 180 deg splitters. The beam forming structure also minimizes the overall front-end losses. The path loss is minimized from the compact design and minimum cross-over. The design minimizes the signal losses because of the beam split loss by use of unequal amplitude weight function. With the amplitude taper function, the beam split loss is less than 0.25 dB because of the unequal signal split ratio. The beam split loss can be as much as 3 dB if typical equally-split hybrids are used in the beam forming.

The foregoing description is not intended to limit the invention to the form disclosed herein. Accordingly, variants and modifications consistent with the following teachings, and skill and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An antenna array, comprising:

a reflector structure having a center panel and first and second outer panels with respective generally planar panel surfaces oriented in different directions;

one or more first radiators coupled to the first outer panel;

one or more second radiators coupled to the second outer panel;

one or more third radiators coupled to the center panel;

first, second and third radiator coupling ports;

first and second RF signal input coupling ports; and a three to two beam forming network coupled between said first, second and third radiator coupling ports and said first and second RF signal input coupling ports, said beam forming network comprising a first 0 degree combiner, a second 0 degree combiner, a first 180 degree splitter, a second 180 degree splitter, and a non-overlapping transmission line pattern coupling said splitters and couplers to said first and second RF signal input coupling ports and said first, second and third radiator coupling ports.

2. The antenna array of claim 1, wherein each of said first, second and third radiators comprise plural radiators respectively configured on said first and second outer panels and center panel in first, second and third columns, respectively.

3. The antenna array of claim 1, wherein said first, second and third plural radiators are arranged in groups of six radiators wherein each group is coupled to a beam forming network.

4. The antenna array of claim 1, wherein said transmission line, said splitters and said couplers together comprise a microstrip line pattern having plural segments of varying width and length to implement a phase and amplitude control to create a dual beam radiation pattern from said first, second and third radiators.

5. The antenna array of claim 1, wherein said first 0 degree combiner and second 0 degree combiner are coupled directly to said first and second RF input signal coupling ports, said first 180 degree splitter and second 180 degree splitter are coupled directly to said first and second radiator coupling ports and said first 180 degree splitter and second 180 degree splitter are coupled to said third radiator coupling port by a split transmission line.

6. The antenna array of claim 5, wherein said first 180 degree splitter and second 180 degree splitter are both coupled directly to said first and second 0 degree combiners.

7. The antenna array of claim 6, wherein said first and second 0 degree combiners are configured symmetrically on opposite sides of said first and second 180 degree splitters.

8. The antenna array of claim 7, wherein said split transmission line and third radiator coupling port are configured between said first and second 0 degree combiners and said first and second 180 degree splitters.

9. The antenna array of claim 1, wherein said first and second outer panels are oriented at angle of about 20 to 30 degrees relative to said center panel.

* * * * *